US005862439A

United States Patent [19]

Pozzanghera

[11] Patent Number: 5,862,439

[45] Date of Patent: Jan. 19, 1999

[54] XEROGRAPHIC MACHINE HAVING AN IMPULSE AIR EJECTOR CLEANING SYSTEM

[75] Inventor: Darryl L. Pozzanghera, Rochester, N.Y.

[73] Assignee: Xerox Corporation, Stamford, Conn.

[21] Appl. No.: 62,760

[22] Filed: Apr. 20, 1998

[51] Int. Cl.[6] ..... G03G 21/00

[52] U.S. Cl. ..... 399/98; 399/92

[58] Field of Search ..... 399/91, 92, 98, 399/99; 347/134, 138, 257

[56] References Cited

U.S. PATENT DOCUMENTS

| | | | |
|---|---|---|---|
| 5,028,959 | 7/1991 | Gooray | 399/93 |
| 5,424,806 | 6/1995 | Siegel | 399/1 |
| 5,570,161 | 10/1996 | Andrews et al. . | |
| 5,613,174 | 3/1997 | Denton et al. | 399/98 |
| 5,689,766 | 11/1997 | Hollar et al. | 399/92 |
| 5,729,793 | 3/1998 | Inoue | 399/92 |

FOREIGN PATENT DOCUMENTS

| | | |
|---|---|---|
| 57-181575 | 11/1982 | Japan . |
| 8-171316 | 7/1996 | Japan . |

*Primary Examiner*—Matthew S. Smith

*Attorney, Agent, or Firm*—Tallam I. Nguti

[57] ABSTRACT

A xerographic reproduction machine for producing toner particle copy images of original images on sheet substrates includes a machine frame; a movable image bearing member mounted within and to the frame, the image bearing member having an image bearing surface defining a path of movement thereof. The xerographic reproduction machine also includes xerographic imaging elements mounted at various distributed locations along the path of movement for forming toner particle copy images of original images on the image bearing surface; devices for transferring the toner particle copy images onto sheet substrates for fusing; and an impulse air ejector cleaning system for intermittently purging and cleaning particulate dirt from sensitive elements among the electrostatographic imaging elements. The impulse air ejector cleaning system includes plural air lines, each of which has an air ejection nozzle positioned at a distributed location for directing air therefrom onto a sensitive xerographic imaging element at such location; a container containing pressurized air connected to each air line of the plural air lines; and a control assembly including a quick exhaust valve connected to the plural air lines, for controllably and intermittently releasing blasts of pressurized air from the container through each of the nozzles for purging and cleaning particulate dirt material from surfaces of sensitive xerographic imaging elements.

10 Claims, 2 Drawing Sheets

XEROGRAPHIC MACHINE HAVING AN IMPULSE AIR EJECTOR CLEANING SYSTEM

BACKGROUND OF THE INVENTION

This invention relates generally to xerographic printing, and more specifically to a xerographic machine having an impulse air ejector cleaning system for effectively removing airborne particles that may otherwise adhere to critical xerographic imaging elements of the machine, thus causing copy quality defects.

In the well-known process of xerographic or electrostatographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern known as a latent image. The latent image is developed by contacting it with a developer material consisting for example of carrier particles and powder-like toner.

The toner is attracted and held onto the image areas by electrostatic charge on the photoreceptor surface. Thus, a toner image is produced in conformity with a light image of the original being reproduced. The toner image is then transferred to a copy sheet, and affixed thereto to form a permanent record of the image to be reproduced. Following such development and transfer, excess toner left on the photoreceptor is cleaned from its surface. The process is useful for light lens copying from an original document, for scanned copying, or for printing electronically generated or stored originals such as with a raster output scanner (ROS), where a charged surface may be imagewise discharged in a variety of ways.

The foregoing discussion generally, describes a typical black and white or single color electrostatographic printing process. The approach utilized for multicolor electrostatographic printing is substantially identical. However, instead of forming a single latent image on the photoreceptor, multiple latent images corresponding to different color separations are sequentially recorded on the photoreceptor. Each single color latent image is developed with toner having a complimentary color. This process is repeated for each of the differently colored images with a respective toner of a complimentary color. Thereafter, each single color separation toner image is transferred to the copy sheet in superimposed registration with the prior color separation toner image, thus resulting in a multilayered, multicolor toner image. This multi-layered, multicolor toner image is then transferred and permanently affixed to a copy sheet in a conventional manner, in order to form a finished color copy.

A constant problem in a xerographic or electrostatographic printing machine as described above which uses dry powder toner, is the detrimental effects of airborne toner and dust particles (created during operation), on critical xerographic elements of the machine. These airborne particles also include loose particles from a document handler, degraded portions of a doctor blade or transfer roll, and the normal dust and dirt from the surrounding environment. Image quality degradation typically results when airborne particles adhere for example to the surfaces of critical components such as the optical components used to discharge areas on the photoreceptor, and on sensors.

Optical components, such as a ROS (raster output scanner) are arranged along an optical path and include mirrors and lenses. Over time, they may acquire a sufficient layer of particles so as to reduce exposure, at the photoreceptor, by partially blocking light reflected from or transmitted through them. The particles can also reduce contrast, in an image exposure profile at the photoreceptor, by scattering light reflected from a mirror component. This may produce dark lines in light areas in conventional charged area development systems, or it may produce light streaks in imaged areas in systems employing discharge area development, the lines in both cases being aligned in the direction of the photoreceptor motion.

Various methods of reducing airborne particle contamination in xerographic printing machines are known in the art. For example, it is well known to provide a continuous, low pressure positive air flow across critical xerographic elements or components so as to prevent particle adhesion at their surfaces. Another technique involves isolating the component for example by placing it inside a housing. However, airborne particles may still affect the cleanliness and effectiveness of such components because turbulent air flow within the machine tends even to allow airborne particles to enter into such housings.

The following briefly summarized additional disclosures may be relevant to various aspects of the present invention. U.S. Pat. No. 5,570,161 for example describes a method for reducing the rate by which airborne particles are deposited on the surface of optical components contained within the housing of a ROS. The lenses, mirrors, and transparent exit window are coated with a low energy material to minimize the Van der Waal and capillary forces that cause small particle adhesion. Electrostatic charge build-up, which attracts larger particles, is reduced by modifying the lateral conductivity of the coating. A fluorinated carbon film is applied to the coating to dissipate the surface charge. Overall efficiency in removing a particulate layer is increased by the addition of air assisted cleaning.

U.S. Pat. No. 5,613,174 describes an air moving device that is coupled to the housing of a ROS for maintaining an outwardly directed flow of air from an open end of the housing so as to move airborne particles away from the open end of the housing. An electrically biased member is located between the ROS and a toner particle carrying surface for attracting toner particles, thus preventing such particles from contaminating the ROS.

Generally thus, it can be seen that xerographic components conventionally, are cleaned or protected against airborne toner particles and other airborne contaminants by using a system of continuous low pressure air that is set to gently blow on critical xerographic components without disturbing their operation. This continuous low pressure air system usually blows approximately one liter of air per minute (or less than one cfm of air) continuously into a component such as an electrostatic voltmeter (ESV) or a patch generator sensor. At best, such conventional continuous low pressure air systems work only marginally. This is because any disturbance of a sensitive component due, for example, to a sudden increase or change in the level of continuous air pressure would likely result in erratic measurements by such component.

For example, such a disturbance likely will result erratic readings of the voltage level on photoreceptor surface. In addition, the continuous blowing of air has to kept at such a low level that is unlikely to disturb toner images on the photoreceptor surface. Unfortunately, however, such a low level of continuous air pressure is also unlikely to blow off some particles on surfaces of critical components that are adjacent to the photoreceptor surface. A good amount of such particles actually settle on these is surfaces during idle periods of the machine, and a gentle continuous air blowing on them after the machine starts up would likely not be enough to purge or remove the particles from such surfaces.

When such components become significantly dirty thus, they invariably start to produce signals that are inaccurate, in turn, affecting other subsystems and controls within the machine. Images produced are detrimentally affected, becoming either too light or too dark, and often having poor quality backgrounds, thus requiring an expensive service call.

SUMMARY OF THE INVENTION

In accordance with the present invention, there is provided a xerographic reproduction machine for producing toner particle copy images of original images on sheet substrates includes a machine frame; a movable image bearing member mounted within and to the frame, the image bearing member having an image bearing surface defining a path of movement thereof. The xerographic reproduction machine also includes xerographic imaging elements mounted at various distributed locations along the path of movement for forming toner particle copy images of original images on the image bearing surface; devices for transferring the toner particle copy images onto sheet substrates for fusing; and an impulse air ejector cleaning system for intermittently purging and cleaning particulate dirt from sensitive elements among the xerographic imaging elements. The impulse air ejector cleaning system includes plural air lines, each of which has an air ejection nozzle positioned at a distributed location for directing air therefrom onto a sensitive xerographic imaging element at such location; a container containing pressurized air connected to each air line of the plural air lines; and a control assembly including a quick exhaust valve connected to the plural air lines, for controllably and intermittently releasing blasts of pressurized air from the container through each of the nozzles for purging and cleaning particulate dirt material from surfaces of sensitive xerographic imaging elements.

BRIEF DESCRIPTION OF THE DRAWINGS

In the detailed description of the invention below, reference is made to the drawings in which.

Figure 1:
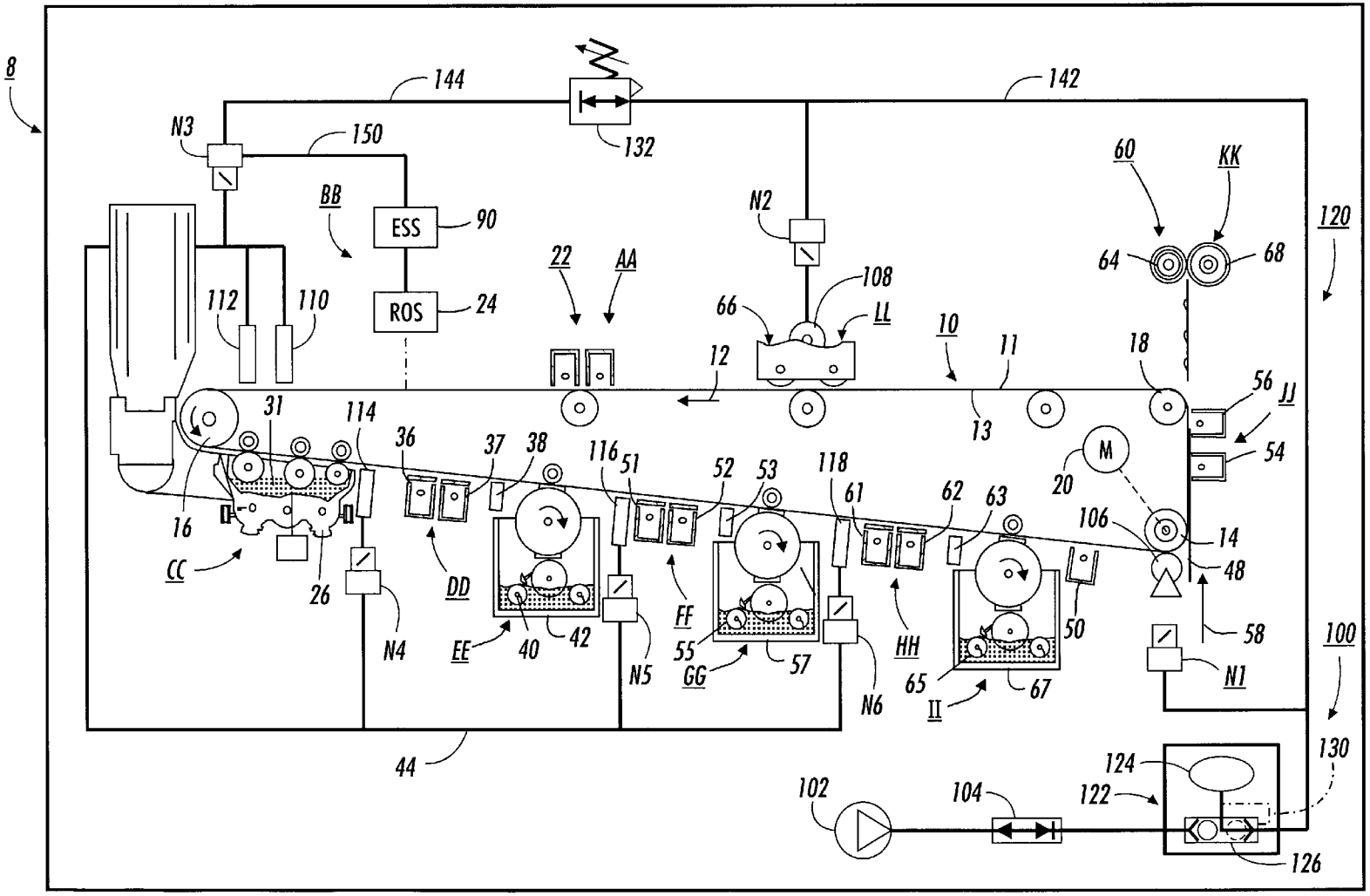
FIG. 1 is an elevational view of an illustrative xerographic printing machine incorporating the pulsed air cleaning system of the present invention.

DETAILED DESCRIPTION OF THE INVENTION.

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

For a general understanding of the features of the present invention, reference is made to the drawings. In the drawings, like reference numerals have been used throughout to designate identical elements. It will become evident from the following discussion that the pulsed air cleaning device of the present invention is equally well suited for use in a wide variety of printing machines and is not necessarily limited in its application to the particular embodiment depicted herein.

Turning now to FIG. 1, there is illustrated a xerographic printing machine, such as an image-on-image machine 8. The printing machine 8 for example employs a photoreceptor 10 in the form of a belt having a photoconductive surface layer 11 on an electroconductive substrate 13. It is understood that the photoreceptor 10 equally can be in the form of a drum. Photoreceptor belt 10 is supported for movement in the direction indicated by arrow 12, for advancing sequentially through various xerographic process stations. As shown, the belt is entrained about a drive roller 14 and two tension rollers 16 and 18. Drive roller 14 is operatively connected to a drive motor 20 for effecting movement of the belt through the xerographic stations.

With continued reference to FIG. 1, a portion of belt 10 first passes through charging station M where a corona generating device, indicated generally by the reference numeral 22, charges the photoconductive surface of belt 10 to a relatively high, and substantially uniform potential. For purposes of example, the photoreceptor is negatively charged, however it is understood that the present invention could be useful with a positively charged photoreceptor, by correspondingly varying the charge levels and polarities of the toners, recharge devices, and other relevant regions or devices involved in the image-on-image color image formation process, as will be hereinafter described.

Next, the charged portion of photoconductive surface is advanced through an imaging station BB. At imaging station BB, the uniformly charged belt 10 is exposed to a laser based output scanning device 24 which causes the charge retentive surface to be discharged in accordance with the output from the scanning device. Preferably the scanning device is a laser Raster Output Scanner (ROS). Alternatively, the ROS could be replaced by other exposure devices, for example, a light lens system. After exposure, an electrostatic latent image is recorded on the photoconductive surface.

At a first development station CC, a magnetic brush developer unit, indicated generally by the reference numeral 26 advances developer material 31 into contact with the electrostatic latent image. Developer unit 26 has a plurality of magnetic brush roller members. These magnetic brush rollers transport negatively charged black dry toner material to the latent image for development thereof. A power supply (not shown) electrically biases developer unit 26.

At a recharging station DD, a pair of corona recharge devices 36 and 37 are employed for adjusting the voltage level of both the toned and untoned areas on the photoconductive surface to a substantially uniform level. A power supply is coupled to each of the electrodes of the corona recharge devices 36 and 37. Recharging devices 36 and 37 substantially eliminate any voltage difference between toned areas and bare untoned areas, as well as reduce the level of residual charge remaining on the previously toned areas, so that subsequent development of different color toner images is effected across a uniform development field.

A second exposure or imaging device 38 is then used to selectively discharge the photoreceptor on toned areas and/or bare areas. This records a second electrostatic latent image on the photoconductive surface. A negatively charged developer material 40, for example, yellow color toner, develops the second electrostatic latent image. The toner is contained in a developer unit 42 disposed at a second development station EE and is transported to the second latent image recorded on the photoconductive surface by a donor roll. A power supply (not shown) electrically biases the developer unit to develop this latent image with the negatively charged yellow toner particles 40.

At a second recharging station FF, a pair of corona recharge devices 51 and 52 are employed for adjusting the voltage level of both the toned and untoned areas on the photoconductive surface to a substantially uniform level. A power supply is coupled to each of the electrodes of corona recharge devices 51 and 52. The recharging devices 51 and 52 substantially eliminate any voltage difference between toned areas and bare untoned areas, as well as to reduce the level of residual charge remaining on the previously toned areas so that subsequent development of different color toner images is effected across a uniform development field.

A third latent image is recorded on the photoconductive surface by imaging device 53. This image is developed using a third developer material 55 contained in a developer unit 57 disposed at a third development station GG. An example of a suitable third developer material is magenta. Suitable electrical biasing of the developer unit 57 is provided by a power supply, not shown.

At a third recharging station HH, a pair of corona recharge devices 61 and 62 adjust the voltage level of both the toned and untoned areas on the photoconductive surface to a substantially uniform level. The recharging devices 61 and 62 substantially eliminate any voltage difference between toned areas and bare untoned areas as well as to reduce the level of residual charge remaining on the previously toned areas, so that subsequent development of different color toner images is effected across a uniform development field.

A fourth latent image is created using imaging device 63. The fourth latent image is formed on both bare areas and previously toned areas of the photoreceptor that are to be developed with the fourth color image. This image is developed, for example, using a cyan developer material 65 contained in developer unit 67 at a fourth development station 11. Suitable electrical biasing of the developer unit 67 is provided by a power supply, not shown.

For the dry developer material case, developer units 42, 57, and 67 are preferably of the type known in the art which do not interact, or are only marginally interactive with previously developed images. For examples, a DC jumping development system, a powder cloud development system, and a sparse, non-contacting magnetic brush development system are each suitable for use in an image-on-image color development system.

In order to condition the toner for effective transfer to a substrate, a negative pre-transfer corotron member 50 negatively charges all toner particles to the required negative polarity to ensure proper subsequent transfer.

A sheet of support material 48 is advanced, in the direction of arrow 58, to transfer station JJ by a sheet feeding apparatus, not shown. Preferably, the sheet feeding apparatus includes a feed roll contacting the uppermost sheet of a stack of copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station JJ.

Transfer station JJ includes a transfer corona device 54 which sprays positive ions onto the backside of sheet 48. This attracts the negatively charged toner powder images from the belt 10 to sheet 48. A detack corona device 56 is provided for facilitating stripping of the sheets from belt 10.

After transfer, the sheet continues to move onto a conveyor (not shown) which advances the sheet to fusing station KK. Fusing station KK includes a fuser assembly, indicated generally by the reference numeral 60, which permanently affixes the transferred powder image to sheet 48. Preferably, fuser assembly 60 comprises a heated fuser roller 64 and a backup or pressure roller 68. Sheet 48 passes between fuser roller 64 and backup roller 68 with the toner powder image contacting fuser roller 64. In this manner, the toner powder images are permanently affixed to sheet 48. After fusing, a chute, not shown, guides the advancing sheet 48 to a catch tray, not shown, for subsequent removal from the printing machine by the operator.

After the sheet of support material is separated from photoconductive surface of belt 10, the residual toner carried on the photoconductive surface is removed therefrom. The toner is removed at cleaning station LL using a cleaning brush structure contained in a housing 66.

Figure 2:
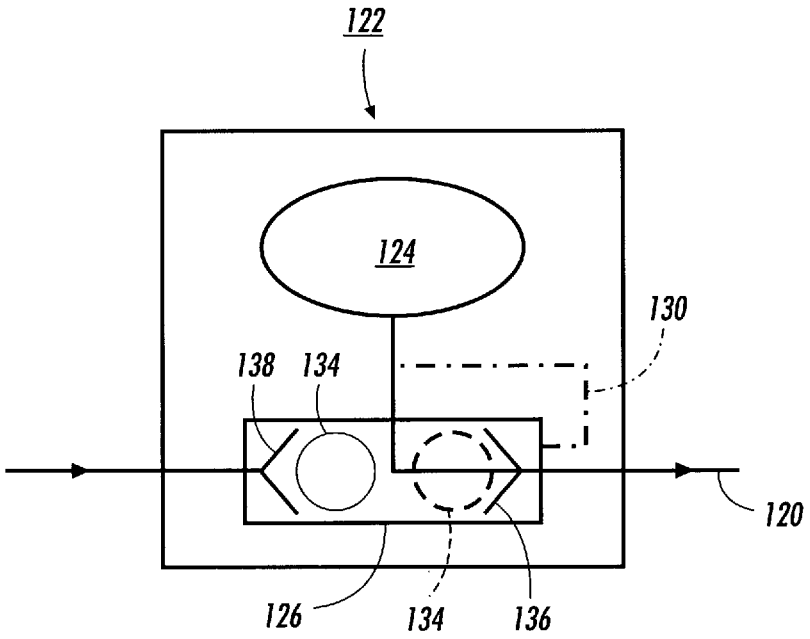
FIG. 2 is a schematic illustration of the impulse air ejector device of the pulsed air cleaning system of the present invention.

Referring now to FIGS. 1 and 2, the xerographic printing machine 8 importantly includes the impulse air ejector cleaning system of the present invention, shown generally as 100. The impulse air ejector cleaning system 100 as shown includes a source 102 of compressed air. The source 102, for example, can be an existing air compressor within the machine 8, and can include a first pressure regulator 104 for adjusting the pressure of the air from the compressor 102 to a desired level.

The impulse air ejector cleaning system 100 as shown, importantly includes a series of solenoid controlled exhaust nozzles N1, N2, N3, N4, N5, and N6, for example, that are each positioned strategically adjacent a critical xerographic component to be purged and cleaned pneumatically. N1 for example is positioned adjacent a hybrid air knife 106 for purging airborne particles from the pressure port and manifold (not shown) for the air knife. N2 is positioned similarly adjacent the flicker bar 108 of the cleaner apparatus 66; N3 is positioned adjacent a patch generator 110, and a first electrostatic voltmeter (ESV) 112; and N4, N5 and N6 are positioned adjacent a second, a third and a fourth electrostatic voltmeter (ESV) 114, 116 and 118, respectively.

Electrostatic Voltmeters (ESV) such as these, for example, are utilized within xerographic machines to control the photoreceptor charging voltage, voltage increases of a charging device, and the charge level of charged area images on the photoreceptor. Similar electrostatic measurement devices are also used in xerographic machines for generating a modified electrical signal in proportion to an electrostatic potential present on a surface. Such a device may include a sensor for producing a signal representative of the electrostatic potential on the surface. Each such device is a potential application for the impulse air ejector cleaning system 100, and hence for adjacent positioning of a solenoid controlled exhaust nozzle, as above. As further shown, the system 100 includes a series of pneumatic lines shown generally as 120 for connecting the nozzles N1 to N6 to the source 102 of compressed air. The pneumatic lines 120, as shown, may include a first size of lines 142 for handling 30 psi and a second size of lines 144 for handling 5 psi.

Referring now to FIGS. 1 and 2, the impulse air ejector cleaning system 100, in accordance with the present invention, most importantly includes an impulse air ejector assembly shown generally as 122, that is connected to the source 102 of compressed air, and to the pneumatic lines 120. An impulse ejector assembly of the type that can be made part of the system 100 is disclosed for example on page 132 of an academic text book entitled Introduction to Pneumatics, by Festo and Didactic, copyrighted 1982. Such impulse ejectors are used in different applications on assembly lines in manufacturing to produce air blasts that cause reject parts, for example, to be ejected off the assembly lines.

The impulse air ejector assembly 122, as is well known and shown, includes a tank 124 for receiving and storing compressed air, an activatable three way, two position inlet-outlet valve 126, and a quick exhaust valve 130. The size of the tank 124 is determined by the maximum amount of air volume required to be delivered to a single component, and by the number of components (the load) to be purged. The input pressure to the tank 124 is determined by the compressor motor or by the first regulator 104.

The impulse air ejector cleaning system 100 also includes an air loop made of the air lines 120, and the tank 124 of compressed air which is charged and recharged from the air compressor 102. In accordance with the present invention, the system 100 selectively delivers an intermittent blast of pressurized air from the tank 124 and through the air loop 120 to critical xerographic subsystems and components, such as to the ESVs 112 to 118, that have to be cleaned and maintained clean.

Accordingly, at preprogrammed and desired intervals during operation of the machine 8, 5 to 30 psi of compressed and regulated air can be released by the system 100 onto critical xerographic components, in order to effectively clean them by forcibly purging and removing any airborne particles, particularly relatively heavier such particles, that may have found their way onto such components during idle periods of the machine 8. The critical components for example include electrostatic voltmeter (ESVs), air manifolds, optic subsystem lenses, sensors, and a clean subsystem flicker bar. The maximum air pressure level for the blast of air is based for example on the pressure required to effectively clean a subsystem requiring the most pressure across a given distance. Although 30 psi is mentioned as a high or maximum pressure from the impulse ejector 122, the actual pressure level could be higher or lower depending on the needs of the machine, the materials contributing to airborne contamination, and the environment. Such purging and cleaning or removal of airborne particles preferably is carried out during start up, shut down and idle periods of the machine in order to allow use of relative high and strong air pressure without disturbing reliable operation of critical components being cleaned. The result will be fewer costly service calls, improved process reliability and improved copy quality due to a reduction in print defects.

In operation, compressed air flows through the 3 way, 2 position inlet-outlet valve 126, through the quick exhaust valve 130, and into the container 124 in order to charge or fill the container to a desired pressure. Such desired pressure can be determined by a first pressure regulator 104. At preprogrammed or desired moments, air flow from the compressor 102 into the tank or container 124 is interrupted, and the quick exhaust valve 130 is actuated. The quick exhaust valve is actuated as an impulse that is triggered either manually (push button),or automatically mechanically, pneumatically, or electro-pneumatically (by sending a signal to a solenoid) Such actuation opens the quick exhaust valve 130 and the outlet side 136 of the inlet-outlet valve assembly 126, and a pulse or blast of pressurized air flows into the air lines 120 and through solenoid controlled nozzles onto critical xerographic components to be purged.

Ideally, several xerographic components/devices in the machine could be connected with the air lines 120 and have an electro-pneumatic switch (not shown) controlling each. Then, when the impulse ejector 122 is "tripped", individual or collective xerographic components are purged of dirt and toner contaminants. The frequency of operation as well as components/devices to be affected can be preset in machine firmware.

For devices that require a higher pressure, such as dirt manifolds, the impulse ejector 122 would be selected to accommodate this, having a larger tank 124. When the pressure is released the air lines 120 are then pressurized and affect the component(s) that need the higher pressure. When such purging is carried out, it is preferable that the machine fan (not shown) be operating so that the airborne particles will be moved down air hoses to their respective cyclone separators and filters (not shown), thereby making good use of negative machine pressure already present from the machine fan.

If the pressure of the pulse or blast of air from the tank 124, for example at 30 psi is too high or strong for some devices, which may instead require a relatively lower pressure, such as 5 psi, to effect cleaning, a second pressure regulator 132 can be added as shown to throttle down the higher pressure. This is necessary because the higher pressure may do damage or make unwanted contaminants become airborne which, in turn, may adversely affect other areas of the machine.

When the quick exhaust valve 130 is actuated, the three-way two position inlet-outlet valve 126 changes state from closed to open. In other words, the ball plunger 134 changes position from blocking the outlet port 136 of the valve 126, to blocking the inlet port 138 and thus interrupting air flowing into the tank 124 from compressor 102. With the outlet port 136 opened thus, the stored air from tank 124 is released as a blast of air from the tank and through the outlet port 136 into the lines 120. The release of such air will continue as long as the duration of the impulse actuating the valve 130 lasts. The impulse actuation could therefore be very brief, for example, one second, or it could be very long, up to a minute or two in duration. The longer the duration, however, the more the volume of air that needs to be stored, hence requiring a relatively bigger tank 124. When the quick exhaust valve 130 is deactivated, the three-way two position inlet-outlet valve 126 will again change or reverse its state from closed to open, relative of course to air flow into the tank 124.

The impulse air ejector cleaning system 100 and the various other machine functions described above are generally managed and regulated by a controller or electronic control subsystem (ESS) 90, preferably in the form of a programmable microprocessor. The microprocessor controller 90, connected for example by means 150 to the impulse air ejector cleaning system 100, provides electrical command signals for operating all of the machine subsystems.

As can be seen, there has been provided a xerographic reproduction machine for producing toner particle copy images of original images on sheet substrates includes a machine frame; a movable image bearing member mounted within and to the frame, the image bearing member having an image bearing surface defining a path of movement thereof. The xerographic reproduction machine also includes xerographic imaging elements mounted at various distributed locations along the path of movement for forming toner particle copy images of original images on the image bearing surface; devices for transferring the toner particle copy images onto sheet substrates for fusing; and an impulse air ejector cleaning system for intermittently purging and cleaning particulate dirt from sensitive elements among the xerographic imaging elements. The impulse air ejector cleaning system includes plural air lines, each of which has an air ejection nozzle positioned at a distributed location for directing air therefrom onto a sensitive xerographic imaging element at such location; a container containing pressurized air connected to each air line of the plural air lines; and a control assembly including a quick exhaust valve connected to the plural air lines, for controllably and intermittently releasing blasts of pressurized air from the container through each of the nozzles for purging and cleaning particulate dirt material from surfaces of sensitive xerographic imaging elements.

The advantages of the impulse air ejector cleaning system of the present invention, for example include the facts that very little attention is required for its operation after set-up, thus saving money. Because the system preferably is operated during non-imaging periods such as cycle up or cycle down time of the xerographic machine, this preserves or prevents disturbances to voltage measurements during the printing or imaging periods of the machine. Pulsing or blasting the components with air during cycle up, cycle down, or between image panels also would preserve the toner images on the imaging surface. Different appropriate pressures can be used on different components by installing pressure regulators at appropriate points along the air lines of the system. Thus with the use of the present invention, the machine 8 will be able to "clean" itself on site and provide the customer with a smoother running machine. This will provide a marked improvement over the present continuous low pressure system.

While the present invention has been described with reference to a preferred embodiment, it will be appreciated from this teaching that within the spirit of the present invention, various alternative modifications, variations or improvements therein may be made by those skilled in the art.

What is claimed is:

1. A xerographic reproduction machine for producing toner particle copy images of original images on sheet substrates, the reproduction machine comprising:

(a) a machine frame;

(b) a movable image bearing member mounted within and to said frame, said image bearing member having an image bearing surface defining a path of movement thereof;

(c) xerographic imaging elements mounted at various distributed locations along said path of movement for forming toner particle copy images of original images on said image bearing surface;

(d) means for transferring the toner particle copy images onto sheet substrates for fusing; and (e) an impulse air ejector cleaning system for intermittently purging and cleaning particulate dirt from sensitive elements among said xerographic imaging elements, said impulse air ejector cleaning system including:

(i) plural air lines, each air line of said plural air lines having an air ejection nozzle positioned at a distributed location for directing air therefrom onto a sensitive xerographic imaging element at such location;

(ii) a container containing pressurized air connected to each air line of said plural air lines; and (iii) control means including a quick exhaust valve connected to said plural air lines, for controllably and intermittently releasing blasts of pressurized air from said container through each said nozzle for purging and cleaning particulate dirt material from surfaces of sensitive xerographic imaging elements.

2. The xerographic reproduction machine of claim 1, wherein said control means includes an actuatable three way, two position inlet-outlet valve.

3. The xerographic reproduction machine of claim 1, wherein said container containing compressed air is connected to an air compressor for receiving and storing pressurized air at a desired pressure level.

4. The xerographic reproduction machine of claim 1, including air pressure regulators for throttling a pressure of compressed air as stored in said container down to a desired lower pressure for use in air lines for purging and cleaning relatively more delicate imaging elements of the machine.

5. The xerographic reproduction machine of claim 1, wherein said control means includes a programmable controller for intermittently actuating said impulse air ejector cleaning system only during non-imaging periods of the xerographic machine so as not to disturb operation of imaging elements of the machine.

6. An impulse air ejector cleaning system for intermittently purging and cleaning particulate dirt from sensitive elements of a xerographic reproduction machine, said impulse air ejector cleaning system comprising:

(a) plural air lines, each air line of said plural air lines having an air ejection nozzle positioned at a distributed location for directing air therefrom onto a sensitive xerographic imaging element at such location;

(b) a container containing pressurized air connected to each air line of said plural air lines; and (c) control means including a quick exhaust valve connected to said plural air lines, for controllably and intermittently releasing blasts of pressurized air from said container through each said nozzle to purge and clean particulate dirt material from surfaces of sensitive xerographic imaging elements.

7. The impulse air ejector cleaning system of claim 6, wherein said control means includes an actuatable three way, two position inlet-outlet valve.

8. The impulse air ejector cleaning system of claim 6, wherein said container containing compressed air is connected to an air compressor for receiving and storing pressurized air at a desired pressure level.

9. The impulse air ejector cleaning system of claim 6, including air pressure regulators for throttling a pressure of compressed air as stored in said container down to a desired lower pressure for use in air lines for purging and cleaning relatively more delicate imaging elements of the machine.

10. The impulse air ejector cleaning system of claim 6, wherein said control means includes a programmable controller for intermittently actuating said impulse air ejector cleaning system only during non-imaging periods of the xerographic machine so as not to disturb operation of imaging elements of the machine.

* * * * *